US005355989A

United States Patent [19]

Best

[11] Patent Number: 5,355,989

[45] Date of Patent: Oct. 18, 1994

[54] METHOD AND SYSTEM FOR OPERATING ELECTRONIC COIN VALIDATORS

[75] Inventor: Jochen Best, Appen, Fed. Rep. of Germany

[73] Assignee: National Rejectors, Inc. GmbH, Fed. Rep. of Germany

[21] Appl. No.: 903,857

[22] Filed: Jun. 25, 1992

[30] Foreign Application Priority Data

Jun. 26, 1991 [DE] Fed. Rep. of Germany ..... 4121034

[51] Int. Cl.[5] ..... G07D 5/08

[52] U.S. Cl. ..... 194/317

[58] Field of Search ..... 194/206, 207, 318, 317, 194/319; 324/236

[56] References Cited

U.S. PATENT DOCUMENTS 4,538,719 9/1985 Gray et al. ..... 194/317
5,067,604 11/1991 Metcalf ..... 194/318 X
5,167,313 12/1992 Dobbins et al. ..... 194/317

*Primary Examiner*—F. J. Bartuska
*Attorney, Agent, or Firm*—Faegre & Benson

[57] ABSTRACT

A method for operating an electronic coin validator, wherein at least one test probe generates a measuring signal if a coin passes the probe. The digitized measuring signal is compared with an upper and a lower reference value which define an acceptance band. A validity signal is generated if the measuring signal lies within the acceptance band. The measuring signal is also compared with a second upper and lower reference value defining a second acceptance band which is narrower than the first acceptance band relative to at least one of the reference values. The second acceptance band is alternatively used for the generation of the validity signal if the measuring signal of at least one coin is outside the second acceptance band, whereas the first acceptance band is used if the measuring signal of at least one coin is within the second acceptance band.

24 Claims, 5 Drawing Sheets

METHOD AND SYSTEM FOR OPERATING ELECTRONIC COIN VALIDATORS

The invention refers to a method for operating electronic coin validators.

BACKGROUND OF THE INVENTION

Electronic coin validators include at least one probe which tests a physical property of coins, e.g. the material. Frequently, inductive probes are used, with the damping of the probe being characteristic for a coin. The analogue measuring signal is digitized and then compared with a reference value in order to generate a validity signal for a genuine coin or a rejection signal for a false (counterfeit) or foreign coin. The digital measuring signal normally is processed in a microprocessor which also controls the receipt of a coin and the sorting thereof. The reference value is stored in the memory of the microprocessor.

Usually, more than a single discrete reference value is used for coins of a given denomination because the manufacture of valid coins results in some variance in the properties to be tested. Due to the manufacturing of coins in different years, the wear of the coins, and their contamination, the band of acceptable tolerances must considerably increase.

It is desirable to accept all valid colds in vending machines, and therefore an upper and a lower reference value are determined for each coin denomination, forming a so-called acceptance band. If the measuring signal is within the acceptance band, a validity signal is generated. Preferably, the reference values of an acceptance band are selected such that the measuring signals of all valid coins of a given denomination fall within the acceptance band.

DESCRIPTION OF THE PRIOR ART

The reference values can be determined by means of either test coins or an arbitrary selection of valid coins. From the German patent specification 31 03 371, it has become known how to create a microprocessor with a learning program which determines the reference values by the introduction of valid coins during its operation. After prolonged operation and the effect of environmental influences, the electronic and electric components of the coin validator change their behavior (drift). Additionally, valid coins change their properties over a long period of time, and therefore reference values need to be updated. It has become known from the mentioned patent and also from the EP 0 155 126 how to modify the reference values either continuously or periodically based on the range of the measuring signals of coins throughout the operational life. The coin validator is therefore automatically adapted to the changed conditions so that later calibrations can be avoided.

The known methods have the advantage that they optimize the acceptance of genuine coins. A coin validator must not only be able to provide a good acceptance rate for genuine coins, it must also reject false coins. It is difficult to meet both of these requirements simultaneously.

The statistical distribution of measuring signals generated by genuine coins corresponds to a so-called Gaussian distribution, in which the majority of the coins have measuring signals midway between the limit values, while only a small percentage have measuring signals adjacent to the limit values. False or foreign coins normally are manufactured or selected such that their properties resemble those of genuine coins. The statistical distribution of measuring signals of such coins also corresponds to a Gaussian distribution. The distribution of measuring signals for foreign or false coins intersects the distribution of valid coins. The result of this is that using a broad acceptance band which allows for acceptance of all valid coins will also provide a relatively high acceptance rate for false or foreign coins.

SUMMARY OF THE INVENTION

The invention indicates a method which has a high acceptance rate for valid coins and a low acceptance rate for false coins.

In the method of the invention, the measuring signals are compared with a second acceptance band which is narrower than the first acceptance band. For example, the upper limit or reference value for the second acceptance band is lower than that of the first acceptance band, thus creating a more restricted range. There are two separate questions being asked for each coin: which acceptance band will be selected for the next coin (selection comparison), and does the measuring signal fall within the acceptance band selected for this coin (validity comparison).

Whether the measuring signal is within or without the second acceptance band will determine which acceptance band is selected for the generation of a validity or rejection signal for subsequent coins. If the measuring signal of at least one coin is outside the second acceptance band, the second acceptance band will be used for the validity comparison of subsequent coins. However, if the measuring signal of at least one coin is within the narrower second acceptance band, then the first acceptance band will be used for the validity comparison of subsequent coins.

The method of this invention relies upon the following observations. As already mentioned, a part of the measuring signal distribution of false coins overlaps the measuring signal distribution for valid coins. If an acceptance band is chosen such that nearly all valid coins are accepted, some false coins will have measuring signals within this acceptance band, and will therefore be accepted. If the measuring signal of the coin being tested is adjacent to a limit value for genuine coins, the probability is much larger that the coin being measured is a false coin than a valid coin. See FIG. 1 which shows that a coin with a measuring signal near $R_o$ is more likely to come from coins having those characteristics falling along curve F than from curve E.

In order to have a high rejection rate for false coins, the coin validator is switched to the narrower second acceptance band. This narrow second band has a smaller intersection with the measuring signal distribution of false coins. Therefore, by switching to the second band, the probability of subsequent false coins being accepted drops significantly. It is clear, however, that by using this method a valid coin may also be rejected, but the probability of this happening is relatively small.

The invention considers further that in an attempt to defraud the machine, many false or foreign coins will be used consecutively. The method according to the invention cannot avoid the acceptance of a single false coin. Switching to a narrow acceptance band, however, results in a rejection of subsequent false coins. When the measuring signal of a test coin is within the narrow second acceptance band, the probability is large that this is a genuine coin and that subsequent coins will also be genuine. Therefore switching back to the broader first acceptance band can take place.

By a corresponding selection of the switching limit between the first and the second acceptance bands, the acceptance rate for false coins can be remarkably reduced without significantly reducing the acceptance rate for genuine coins.

As can be seen, switching from the first to the second acceptance band can be implemented by comparing the measuring signal with a reduced reference value. Theoretically it is conceivable to determine another value for the switching limit which, however, should be within the first acceptance band. The criteria for determining when to switch to the second band is when the measuring signal of the coin being tested is above a critical value, i.e. outside the second acceptance band. However, it is also possible to wait for two or more measuring signals which are outside the narrow band before switching from the first to the second acceptance band, and vice versa.

In addition to coins, the method described in this invention works with indicia of monetary exchange generally and may be used to differentiate between genuine and counterfeit tokens and currency.

The processing of the measuring signals in the coin validator preferably is done by a microprocessor. The microprocessor is programmed such that it has two measuring channels, and the switching from one measuring channel to the other is initiated by a program of the microprocessor. By doing so, particular circuitry components are not necessary.

The invention is explained in more detail along accompanying drawings.

DETAILED DESCRIPTION OF THE PREFERRED EMBODIMENT

Figure 1:
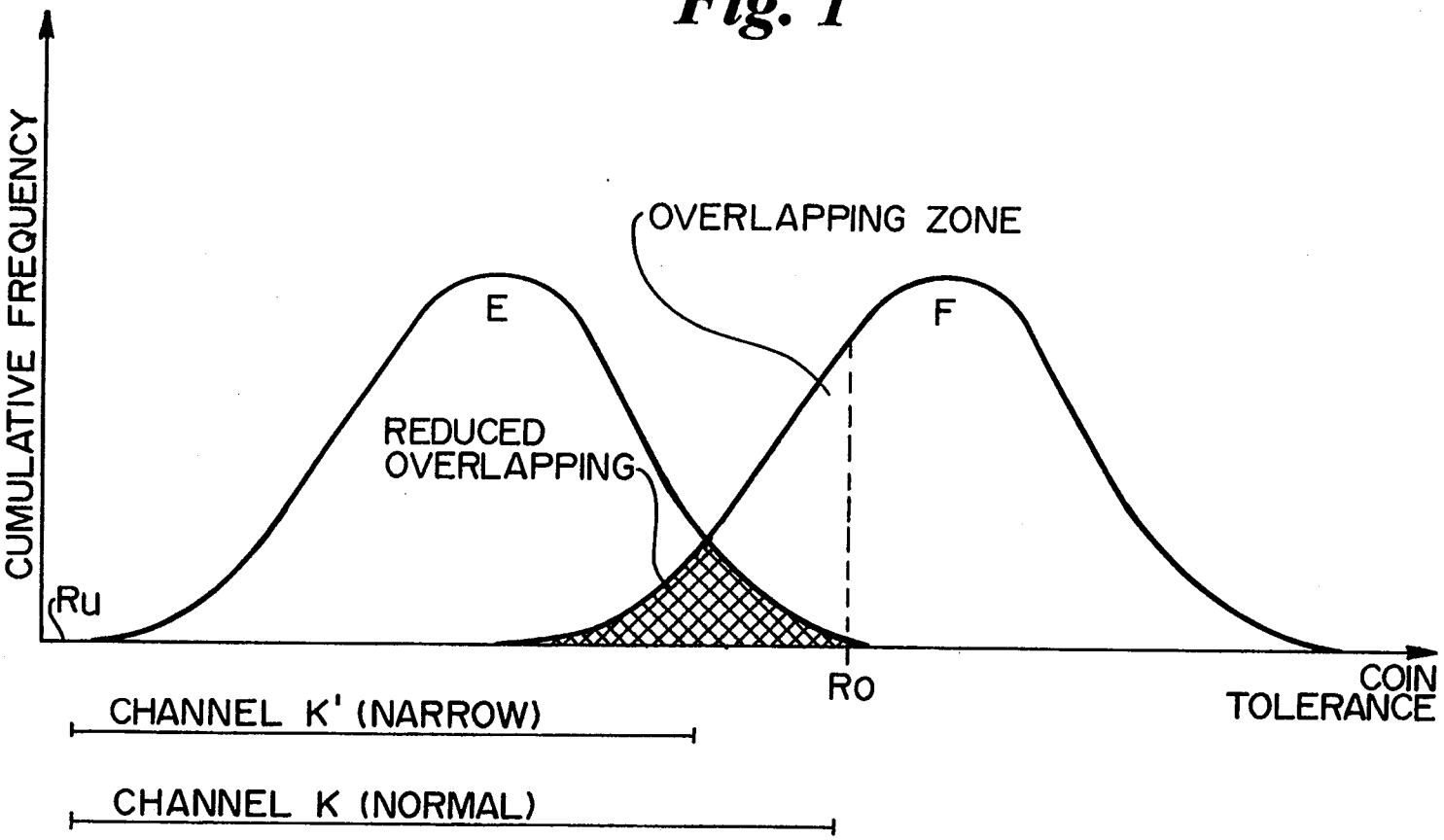
FIG. 1 shows diagrammatically the Gaussian distribution of measuring signals of genuine coins of a particular denomination (curve E) and false coins (curve F)

In the diagram of FIG. 1, two Gaussian distributions, curves E and F, are depicted, with the ordinate (Y axis) corresponding to the number and the abscissa (X axis) to the magnitude of the measuring signals. Curve E represents the distribution of the measuring signals of a valid coin. For example, it is the curve of 1 German Deutschmark (DM) coin, which has a predetermined physical property, the material composition, being measured by means of a test probe. The analogue measuring signal of the test probe is digitized so that qualitative statements and comparisons can be easily made.

As seen in FIG. 1, the measuring signals of most genuine coins are in the medium range between the limit or reference values $r_u$ and $R_o$ of curve E. If the coin validator is to accept all genuine 1 DM coins, the position of the lower and the upper reference values of the test band must be $R_u$ and $R_o$. This acceptance band is indicated in FIG. 1 by range K.

Curve F represents the distribution of measuring signals which occur upon the introduction of Polish 20-Zloty-coins. 20-Zloty-coins are worth only a fraction of 1 DM coins, and therefore are frequently used with intent to defraud. As can be seen, curves E and F overlap each other. The overlapping range is indicated by a dotted line intersecting limit value $R_o$.

If the coin validator operates with the acceptance band of range K, all false coins having a measuring value within the overlapping range will be accepted. In this example, in order to achieve a 100% acceptance rate for valid coins, 30% of false coins will also be accepted.

If a narrower acceptance band is used, namely range K', the overlapping region is reduced and the acceptance rate for false coins is considerably lower (from 30% to 5%). On the other hand, the acceptance rate for genuine coins is also reduced (from 100% to 90%).

Figure 4:
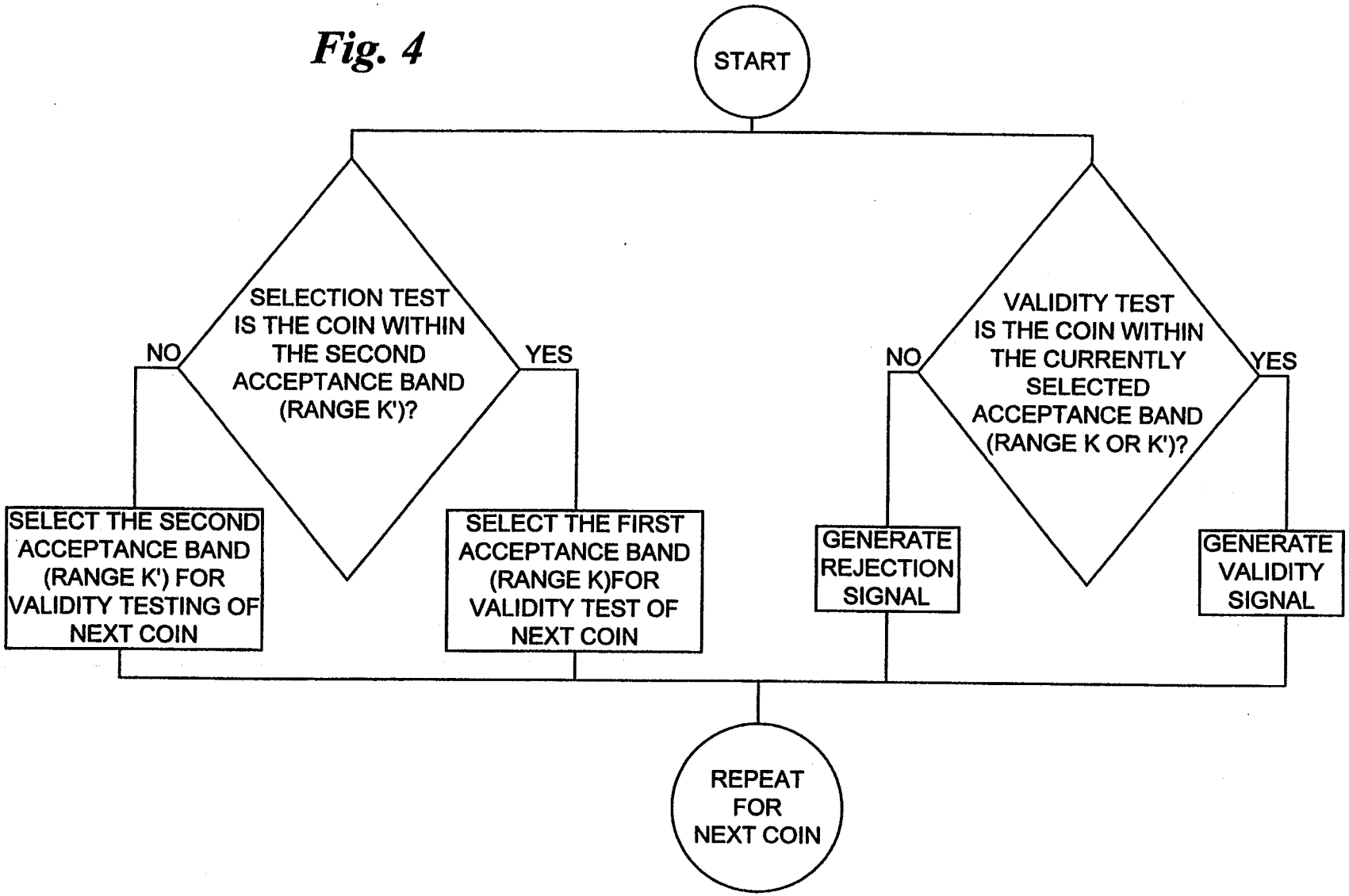
Figure 5:
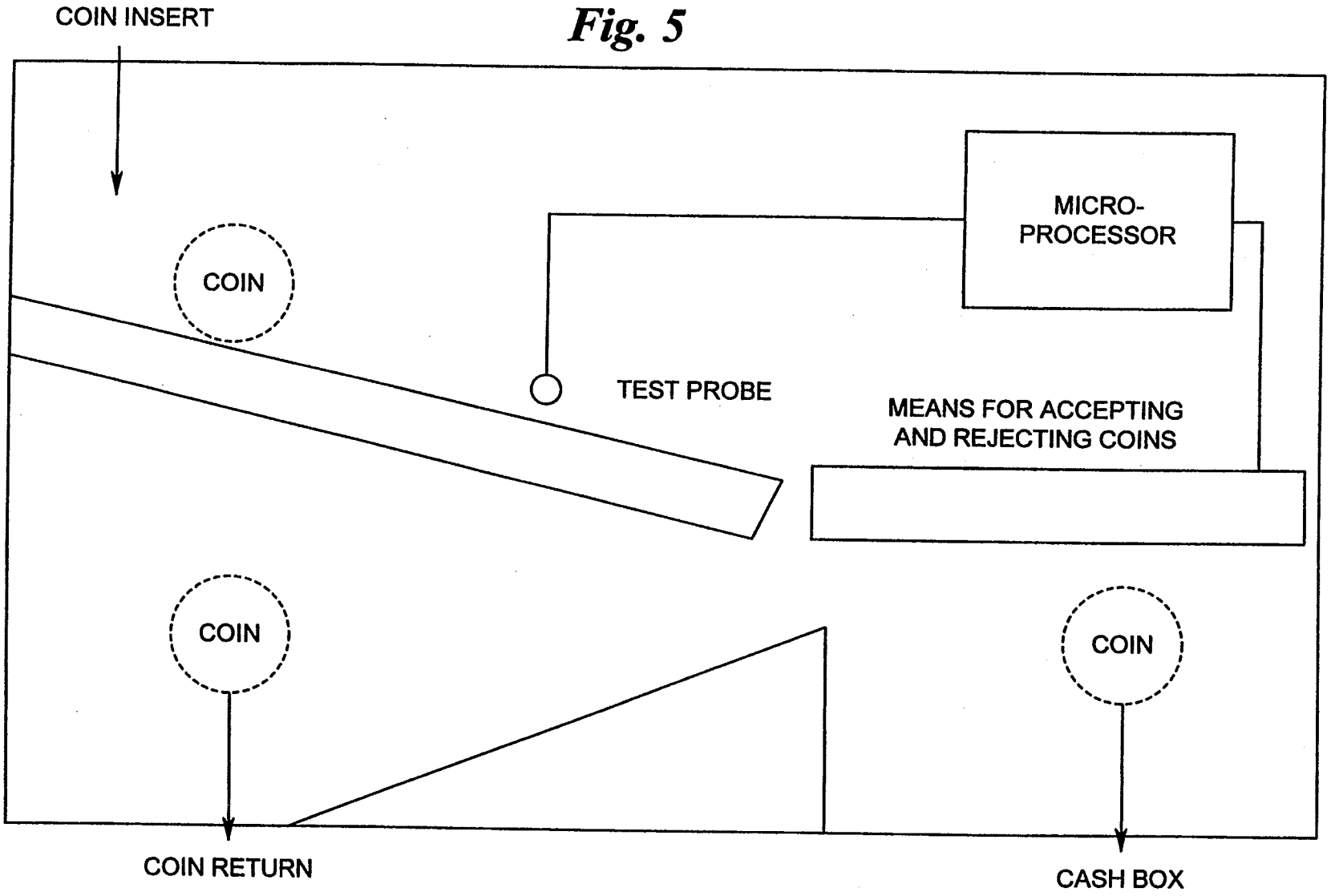
FIG. 5 shows a simplified diagram of an electronic coin validator according to the present invention.

The microprocessor initiates a routine with each introduced coin, as illustrated in the flow chart of FIG. 4. If the measuring signal of a coin is within the acceptance band of narrower range K', the wide acceptance band of range K is selected for the validity comparison of subsequent coins. If the measuring signal is outside the acceptance band of range K', the narrow acceptance band of range K' is selected for the validity comparison of subsequent coins. This selection comparison always uses range K'.

Figure 2:
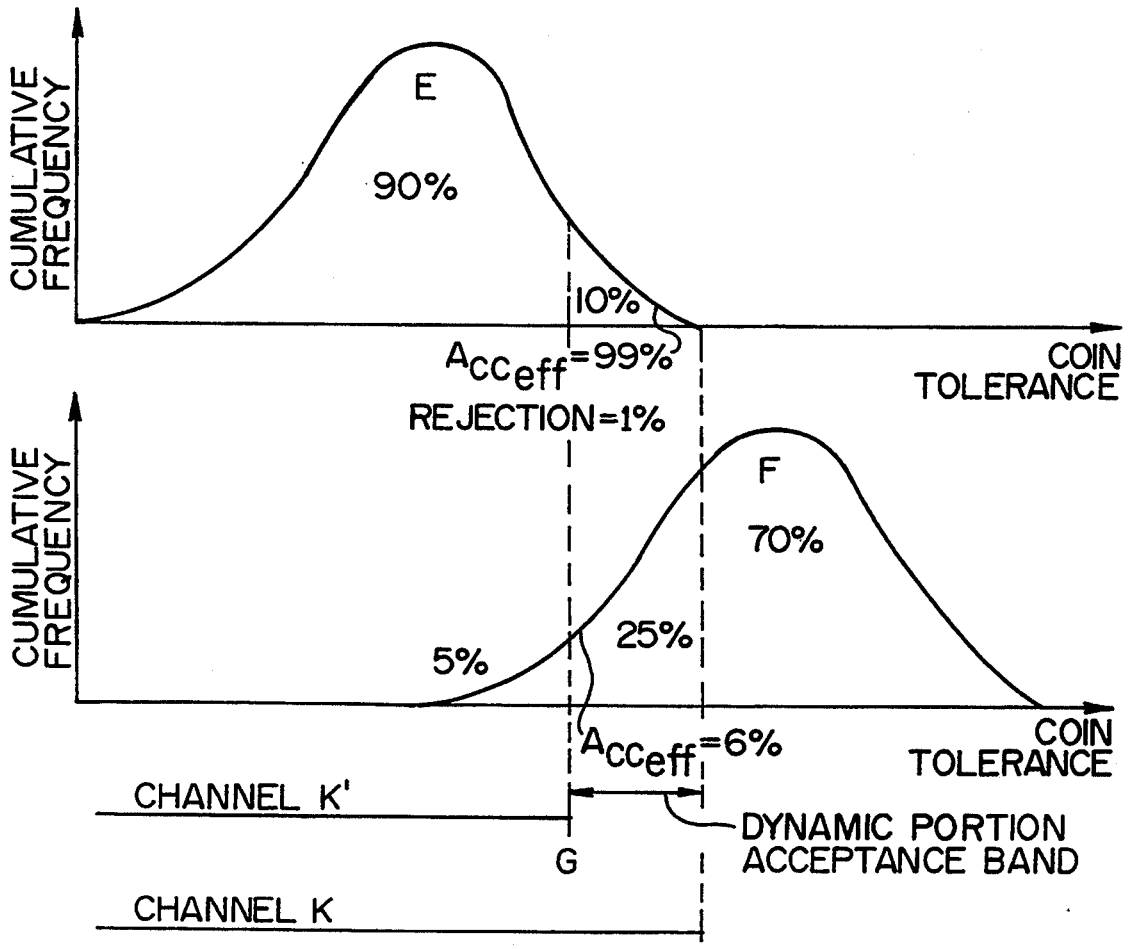
FIG. 2 shows a similar illustration to FIG. 1, with the distribution of the measuring signals of genuine coins and the distribution of the measuring signals of false coins depicted separately.
Figure 3:
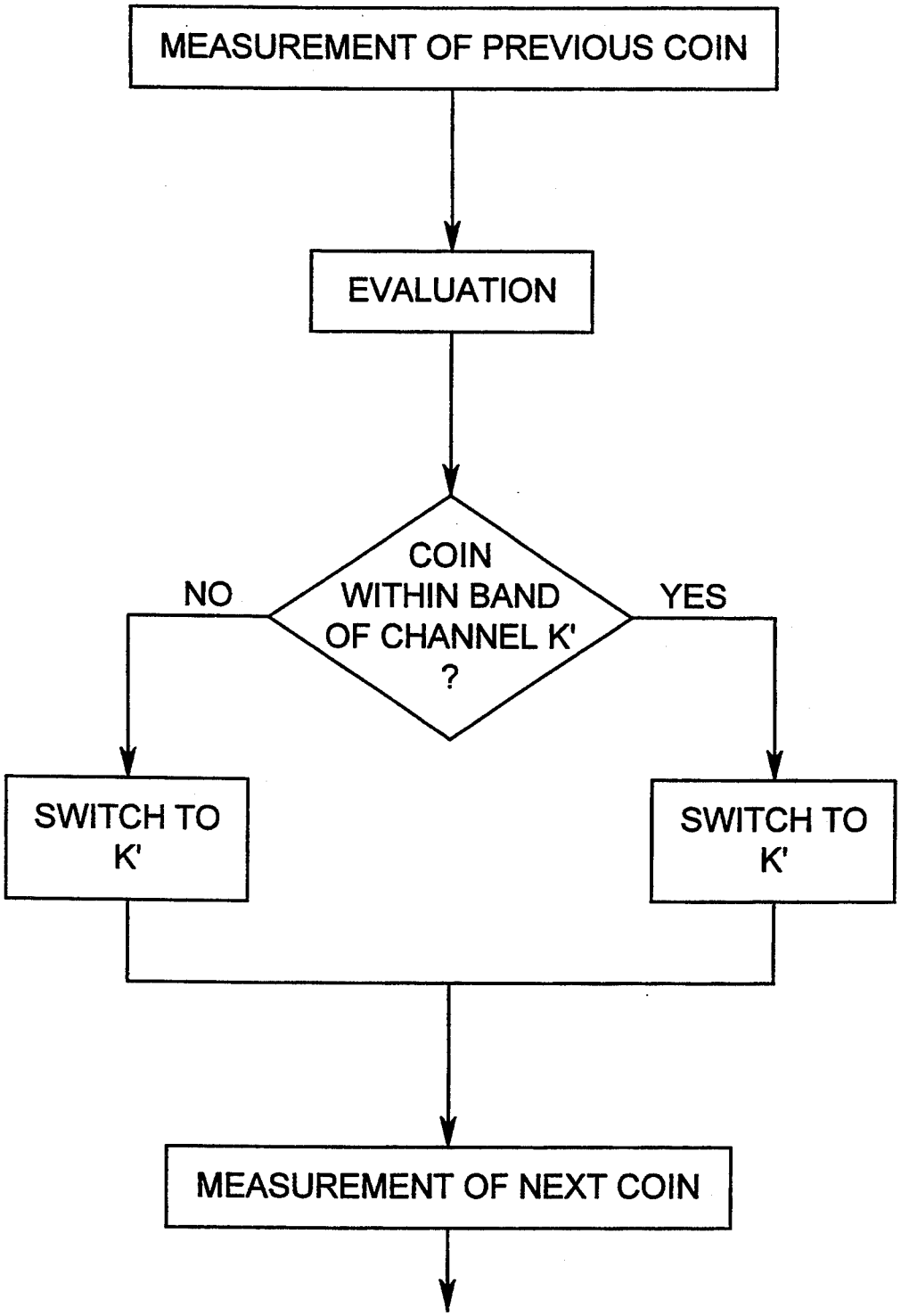
FIGS. 3 and 4 show the algorithm of the method according to the invention for subsequently introduced coins.

In the example of FIG. 2, the limit value G for curves E and F is defined such that statistically 10% of genuine coins are rejected if the coin validator uses the acceptance band of range K'. Concurrently, 5% of false coins are accepted. In the wider range K, 100% of all genuine coins are accepted, as are 30% of all false coins.

Since the coin validator is switched from one acceptance band to the other and back, the acceptance rates cannot be computed in the same manner as for fixed acceptance band tests; rather, the acceptance rates are composed of a constant portion and a dynamic portion. The constant portion is the lower of the acceptance rates for the different acceptance bands. The dynamic portion results from the mathematical probability that the band with the higher acceptance rate is selected multiplied by the difference in acceptance rates between these two bands.

Let M be the acceptance rate for range K and M' be the acceptance rate for range K'. The acceptance rates for the genuine coins of curve E in the example of FIG. 2 are 100% for M and 90% for M'. The last amount is accepted anyway by the electronic validator independent of which active range is used. If range K is currently selected, the acceptance rate for genuine coins is 100% * M=100%; if range K' is selected, then the rate is 100% * M'=90%. Therefore, the minimum acceptance rate is the lower of these two, 100% * M'=90%. This corresponds to the constant portion of the effective acceptance rate.

The dynamic portion is the probability that the band with the higher acceptance rate is selected multiplied by the increased acceptance rate of this band. When a measuring signal of a coin is within the acceptance band of range K', the coin validator is switched to the acceptance band of range K for subsequent coins. The probability for this occurring is represented by the distribution curve, which is M'=90%. When the wider band is selected, the acceptance rate will be increased by M−M′ (100%−90%=10%). The difference M−M′, thus, occurs M′ percent of the time. The dynamic portion can be expressed by the formula M′ * (M−M′).

The effective acceptance rate is the sum of the constant and dynamic portions:

$$\begin{aligned}\text{Effective acceptance} &= M' * 100\% + M' * (M - M') \\ &= M' * (100\% + M - M') \\ &= 90\% * 110\% = 99\%\end{aligned}$$

In the example of FIG. 2, by using this method an effective acceptance rate of 99% is achieved for genuine coins.

The acceptance rate for false coins can also be calculated using this formula. In this example, for curve F, M is 30% and M′ is 5%:

$$\begin{aligned}\text{Effective acceptance} &= 5\% * (100\% + 30\% - 5\%) \\ &= 5\% * 125\% = 6.25\%\end{aligned}$$

The acceptance proportion of valid coins to false coins is 99% to 6.25%. The electronic validator accepts at least an amount of u′=90 % of genuine coins because each coin within range K′ is accepted which is 90% of all genuine coins within range K. The acceptance rate for genuine coins is slightly reduced (from 100% to 99%) while the acceptance rate for false coins is considerably reduced (from 30% to 6.25%).

It is understood that it is possible to increase or decrease the acceptance rate for valid coins by a displacement of the limit G of the narrower acceptance band. In addition, the criteria for a switching from one acceptance band to the other depends upon the quality and the number of coins outside range K′ that are required before the range K is selected, and vice versa. Generally, the following method can be pursued:

n coins smaller than a critical value: switching to the acceptance band of range K; n coins larger than the critical value: switching to the acceptance band of range K′.

If the validating machine measures two or more properties of a coin, then each property's test can have a wide and a narrow acceptance band. In such a system, whether to use the narrow or wide band for each property's validity test can be determined not solely by the results of previous coin(s), but may also take account of test(s) of other properties on the current coin. As an example, if the test for property A gives a value within range $K'_A$, then the band for validity testing of property B will be range $K_B$, and vice versa. Another example is that the wide band of range $K_B$ is only used if the current coin has an A property measurement within range $K'_A$ and the previous coin had a B property measurement within range $K'_B$.

What is claimed is:

1. A method for operating an electronic coin validator wherein at least one test probe generates a measuring signal if a coin passes said probe wherein further said measuring signal is digitized and compared with an upper and a lower reference value defining an acceptance band and wherein a validity signal is generated if said measuring signal lies within said acceptance band, said method being characterized in that at least a second acceptance band is also defined which falls within and is narrower than said first acceptance band, said measuring signal being compared with said second acceptance band, with said second acceptance band being selectively and alternatively used for the generation of said validity signal when said measuring signal of at least one previous coin is outside of said second acceptance band, whereas said first acceptance band is used if said measuring signal of at least one previous coin is within said second acceptance band.

2. The method of claim 1, wherein the first acceptance band is used when the measuring signal of the preceding coin was within said second acceptance band and said second acceptance band is used if said measuring signal of said preceding coin was outside said second acceptance band.

3. The method of claim 1 or 2, wherein the limit values of the statistical distribution of the measuring signals of substantially all valid coins define the reference values of said first acceptance band.

4. The method of claim 1, wherein at least one of the reference values defining said second acceptance band are selected so that the second acceptance band is narrower than said first acceptance band, thereby reducing the probability that a false coin may generate a validity signal.

5. The method of claim 1, wherein the selection of which acceptance band to use for the validity comparison of a given property is based on a combination of selection comparisons for at least one property of said article and previously-tested articles.

6. The method of claim 1, wherein the selection of which acceptance band to use for the validity comparison of a given property is based on a combination of selection comparisons of said property of at least one previously-tested article.

7. The method of claim 6, wherein:

a. the first acceptance band is selected if at least one previously-tested article had a measuring signal within the second acceptance band; and b. the second acceptance band is selected if at least one previously-tested article had a measuring signal without the second acceptance band.

8. The method of claim 6, wherein:

a. the first acceptance band is selected if the previous article had a measuring signal within the second acceptance band; and b. the second acceptance band is selected if the previous article had a measuring signal without the second acceptance band.

9. A method for operating an electronic validator, which comprises;

a. generating measuring signals indicative of at least one property of an article being tested;

b. defining at least two acceptance bands for each measuring signal, wherein a second acceptance band falls within and is narrower than a first acceptance band;

c. establishing a selection comparison by determining whether the measuring signal is within the second acceptance band;

d. selecting the first acceptance band to determine whether to generate a validity or rejection signal for subsequent articles where the selection comparison indicates that the measuring signal is within the second acceptance band, and selecting the second acceptance band to determine whether to generate a validity or rejection signal for subsequent articles where the selection comparison indicates that the measuring signal is outside of the second acceptance band;

e. establishing a validity comparison by determining whether the measuring signal is within currently selected acceptance band;

f. generating a validity signal if the validity comparison yielded a result such that said article had a measuring signal within currently selected acceptance band; and g. generating a rejection signal if the validity comparison yielded a result such that said article had a measuring signal without currently selected acceptance band.

10. The method of claim 9, wherein limit values of a statistical distribution of measuring signals of substantially all valid articles are selected as reference values defining said first acceptance band.

11. The method of claim 9, wherein the limit values for said second acceptance band are selected for minimizing the probability that a measuring signal of a false article will fall within said second acceptance band.

12. The method of claim 9, wherein:

a. the article is accepted if a validity signal was generated; and b. the article is rejected if a rejection signal was generated.

13. Electronic validator apparatus, comprising:

a. means for generating measuring signals indicative of at least one property of an article being tested;

b. means for defining at least two acceptance bands for each measuring signal, wherein a second acceptance band falls within and is narrower than a first acceptance band;

c. means for establishing a selection comparison by receiving said measuring signal and determining whether said measuring signal is within the second acceptance band;

d. selecting means for receiving results of said selection comparison, said selecting means selecting said first acceptance band to determine whether to generate a validity or rejection signal for subsequent articles where said selection comparison indicates that the measuring signal is within said second acceptance band and selecting said second acceptance band for subsequent articles where said selection comparison indicates that the measuring signal is outside of said second acceptance band;

e. means for establishing a validity comparison by receiving said measuring signal and determine whether said measuring signal is within currently selected acceptance band;

f. means for receiving results of said validity test and for generating a validity signal if the validity comparison yielded a result such that said article had a measuring signal within currently selected acceptance band; and g. means for receiving results of said validity test and for generating a rejection signal if the validity comparison yielded a result such that said article had a measuring signal without currently selected acceptance band.

14. The apparatus of claim 13, wherein limit values of a statistical distribution of measuring signals of substantially all valid articles are selected to be reference values defining said first acceptance band.

15. The apparatus of claim 13, wherein said second acceptance band is defined such that there is a small probability that a measuring signal of a false article will fall within said second acceptance band.

16. The apparatus of claim 13, further consisting of:

a. means for accepting the article being tested if a validity signal was generated; and b. means for rejecting the article being tested if a rejection signal was generated.

17. The apparatus of claim 13, wherein the selection of which acceptance band to use for the validity comparison of a given property is based on a combination of selection comparisons for at least one property of said article and previously-tested articles.

18. The apparatus of claim 13, wherein the selection of which acceptance band to use for the validity comparison of a given property is based on a combination of selection comparisons of said property of at least one previously-tested article.

19. The apparatus of claim 18, wherein:

a. the first acceptance band is selected if at least one previously-tested article had a measuring signal within the second acceptance band; and b. the second acceptance band is selected if at least one previously-tested article had a measuring signal without the second acceptance band.

20. The apparatus of claim 18, wherein:

a. the first acceptance band is selected if the previous article had a measuring signal within the second acceptance band; and b. the second acceptance band is selected if the previous article had a measuring signal without the second acceptance band.

21. The apparatus of claim 13, wherein the articles being tested are physical units used as a method of payment.

22. The apparatus of claim 21, wherein the articles being tested are coins.

23. The apparatus of claim 21, wherein the articles being tested are units of paper currency.

24. The apparatus of claim 21, wherein the articles being tested are tokens.

* * * * *